United States Patent [19]

Harrison

[11] 4,456,082

[45] Jun. 26, 1984

[54] EXPANDABLE ROCK BIT

[75] Inventor: Simon J. Harrison, Azilda, Canada

[73] Assignee: Smith International, Inc., Newport Beach, Calif.

[21] Appl. No.: 264,488

[22] Filed: May 18, 1981

[51] Int. Cl.[3] ..... E21B 10/20

[52] U.S. Cl. ..... 175/384; 407/41; 407/49; 175/53; 175/413; 175/406

[58] Field of Search ..... 175/344, 53, 346, 347, 175/406, 412, 413, 342, 382, 384, 357, 358; 299/79, 80, 93; 403/263, 361, 374; 407/41, 49, 94, 95

[56] References Cited

U.S. PATENT DOCUMENTS

| | | | |
|---|---|---|---|
| 3,318,392 | 5/1967 | Hoen | 299/93 |
| 4,108,259 | 8/1978 | Dixon et al. | 175/344 |
| 4,194,578 | 3/1980 | Mitchell | 175/344 X |
| 4,386,670 | 6/1983 | Westermark | 175/344 |

*Primary Examiner*—Ernest R. Purser
*Assistant Examiner*—Michael Starinsky
*Attorney, Agent, or Firm*—Robert G. Upton

[57] ABSTRACT

This invention relates to large diameter raise bore rock bits. The invention comprises a means in which extensions may be attached to the outer diameter of the body of the rock bit, thus providing a variable diameter raise bore rock bit. The extensions are mounted to the primary body of the bit such that compressive loads are imposed on the attachment means. These compressive loads are transmitted from the extensions of the body by designing the extension portions of the bit such that they interlock to the basic bit body. The mating surfaces of the attachment means transmit predominantly compressive loads acting substantially normal to the load bearing surfaces. The attachment means are further designed to increase the grip of the extended bit portions as increased loads are applied to the body of the rock bit.

1 Claim, 5 Drawing Figures

FIG. 4 is a partially cutaway cross sectional view of another embodiment of the invention; and FIG. 5 is a view taken through 5—5 of FIG. 4 illustrating an end view of one of the detachable segments from the expandable raise bore rock bit.

DESCRIPTION OF THE PREFERRED EMBODIMENTS AND BEST MODE FOR CARRYING OUT THE INVENTION

With reference now to FIG. 1, the expandable big hole bit, generally designated as 10, consists of an inner or center primary body 12 with a stem mounted thereto. The pin end 15 of support stem 14 is designed to be connected to a drillstring that is attached to a drilling apparatus (not shown). A multiplicity of rock cutter assemblies, generally designated as 16, consist of a cutter base 21 attached to surface 11 of inner body 12 which supports roller cutters 19.

An expandable section or segment, generally designated as 20, is connected to the inner body 12 by mating the segment 20 adjacent an outer peripheral wall 13 defined by inner body 12. The expandable segment 20 supports radially outwardly positioned cutter support saddles 21 which orient roller cutters 19 adjacent a borehole wall. The cutter saddles 21 are mounted to surface 22 of expandable segment 20.

An inner attachment end 24 consists of an inwardly directed edge 26 which is biased or canted. A tongue 28 extends downwardly from surface 22 that defines an inwardly facing edge or surface 30. End 24 then slips over support block 18 attached to the outer peripheral wall 13 of inner body 12, end 24 fitting into a depression or groove 27 defined between the upper surface 11 of inner body 12 and support block 18. Surface 30, defined by end 24 of expandable segment 20, then comes in contact with surface 17 defined by the inner wall of support block 18. A vertical web 34, which mates with wall 13, adjacent vertical contact surface 32, helps support the expandable segment 20. The vertical web 34 is positioned underneath the support plate 22 of expandable segments 20.

A vertically oriented support web 40 backs up support plate 34 to provide strength for the expandable segment 20.

One or more attachment wedges 44 are provided with a bias surface 45 which is at the same angle as bias surface 26 of expandable segment 20. The attachment wedge with its bias surface 45 is designed to be bolted into plate 23 which is part of the structure of inner bit body 12. A multiplicity of attachment bolts 46 secure the wedges into their respective groove 27, thus securely mounting the expandable segments to the inner body 12. The more pressure applied to each of the attachment bolts 46, the tighter the engagement of the expandable segment to the inner body 12.

With reference now to FIG. 2, vertical support web 34 is similarly fitted with a bias surface. Web 34 fits against surface 13 of the expandable rock bit body 12 and between parallel faces due to a groove 41 cut into support block 18. One or more attachment wedges 50 fit into the groove cut into support block 18 with their bias surfaces 51 against the bias surface 56 attached to vertical support web 34 in such a manner that securing these wedges into said slot draws web 34 into the groove 41 and locks it into place, preventing lateral or twisting movement.

During operation then it can be realized that there are primarily compressive loads imposed by the expandable segments between surface 101 of support block 18 and the bottom surface 25 of extension plate 22. The expandable segment simultaneously imposes compressive loads radially inward against surface 32 of plate 13 of inner body 12. Ordinarily, in the aforementioned state of the art devices the expandable segment would be butted to plate 13 along surface 32 and held in place with bolts having their axis normal to surface 32 and passing through a vertical plate attached to extension 20 and contacting surface 32 (not shown). The loads would put each of the attachment bolts in shear subjected along vertical contact surface 32 (FIG. 1). In the present invention, attachment bolts 46 and 52 are stressed in tension.

With reference again to FIG. 2, the view clearly shows each of the expandable segments 20 attached to the inner body 12 of the bit 10. This view additionally shows a further means to secure the expandable segment 20 to plate 13 affixed to inner body 12. Vertical support blocks 18, affixed to plate 13, define one side of a groove 41. A block 54, secured to vertical web 34, has an inner biased or angled surface 56 which mates with a corresponding surface 51 of a wedge 50. The wedge 50 is secured within the groove 41 by a series of attachment bolts 52. As the expandable segment is dropped into the grooves 27, defined between end 24 and the inner body 12, the vertically oriented wedges 50 further align the expandable segment into position. When the attachment bolts 46 (oriented parallel with the axis of the bit) and the attachment bolts 52 (oriented normal to the axis of the bit) are tightened, the expandable segments automatically move into the correct alignment with respect to the inner center body 12. As heretofore mentioned, the tighter the attachment bolts 46 and 52, the more securely the expandable segments are mounted to the inner body 12.

It should be noted that in operation any twisting modes subjected to the expandable segments will be resisted by the nature in which the expandable segments are attached to the inner body 12. The wedges inherently resist any twisting modes because as the pressure is exerted, the forces are increased due to the angle of the surfaces 45 and 51 of wedges 44 and 50.

The perspective view of FIG. 3 clearly illustrates the attachment means to secure the expandable segment 20 to the inner body 12 of the large diameter bit. The expandable segment is dropped into groove 27, defined in the inner body 12, with the vertical mating surface 32 supporting the expandable segment. Both the wedges 44 and 50 are then inserted within their respective grooves 27 and 41 and the attachment bolts 46 and 52 are tightened simultaneously so that the expandable segment is gradually brought into alignment with respect to the center inner body 12. When all of the attachment bolts 46 and 52 are torqued into position, the expandable segment, with rotating cutter 16 attached thereto, is securely attached to the inner body 12. Any subsequent operating loads subjected to the expandable segment will be taken mostly in compression along surface 101 of inner body support block 18, thus obviating any chance for shear loads being directed to any of the attachment bolts 46 or 52. As heretofore mentioned, the mounting wedges 50 further act to prevent or resist any twisting modes subjected to any of the expandable segments 20 attached to the inner body 12.

Referring now to FIG. 4, an alternative embodiment is illustrated and generally designated as 70. The center body 72 has a stem 74 extending therefrom. An expand-

EXPANDABLE ROCK BIT

BACKGROUND OF THE INVENTION

1. Field of the Invention

This invention relates to large diameter raise bore rock bits.

More specifically, this invention relates to large diameter raise bore rock bits with a means in which the diameter of the rock bit may be increased by attaching radially extending segments to the rock bit.

2. Description of the Prior Art

A number of large diameter drill bits with attachable segments to enlarge the diameter of the drill bit are known in the prior art. For example, U.S. Pat. No. 4,142,598, assigned to the same assignee as the present invention, discloses a large diameter drill bit that is capable of drilling various size boreholes. The bit includes a primary body that supports a plurality of yokes positioned at various radial locations thereon. A frustoconical cutter is rotatably mounted on each yoke for contacting and disintegrating earth formations, the outermost cutters forming the gage row of the bit. A second stage in which larger diameter holes may be drilled comprises a plurality of ear assemblies for attachment to the primary body and circumferential locations between the outermost primary cutters associated with the primary body assembly. Each attachable ear assembly comprises a unitary support frame having a yoke and cutter mounted thereon. Each ear assembly support frame includes a plurality of locating pads axially aligned with the center support body which are adapted to register with mating pads located on the primary body and bolts are provided to extend through the interfaced locating pads to secure the support frame to the primary body.

This invention is disadvantaged in that each of the bolts attaching the secondary assembly to the primary body are subjected directly to shear loads when pressure is applied to the outer secondary members of the expanded drill bit.

Yet another prior art U.S. Pat. No. 4,010,808, teaches a primary cutter means positioned on a bit body for disintegrating the formations out to a first radial distance from the bit axis of rotation. Secondary cutter means are adapted to be connected to the bit body and selectively located in a first position for cutting between said first radial distance and a larger second radial distance and selectively located in a subsequent position between said first radial distance and an even larger subsequent radial distance. Expandable sections are provided to be located between the secondary cutter means and the bit body for locating the secondary cutter means in the subsequent positions. The primary bit is expanded by inserting adapter plates that extend secondary cutter means radially outwardly from the bit. The expanded sections are mounted along a plane parallel with the axis of the bit and each of the attachment bolts which radially extend through the expanded plates are subjected to shear loads under operating pressures from the cutters mounted to the expanded section of the variable diameter rock bit. Thus the same disadvantage associated with the first mentioned patent is associated with the foregoing patent.

The following two patents, namely U.S. Pat. Nos. 4,177,866 and 4,194,578, describe raise boring large diameter rock bits having retractable gage cutting elements. Each of these patents teach a means to hydraulically retract the outer diameter portion of the bits so that the bit may be easily transported through the borehole after the bit has cut the borehole. These two patents also teach a means to start a large diameter hole by hydraulically extending outer segments of the bit. The extended portion may then subsequently be retracted to either remove the bit from the hole or to reduce the borehole diameter while drilling continues. These hydraulically manipulated bits are disadvantaged in that they are not rigid enough to withstand drilling pressures during drilling operations.

SUMMARY OF THE INVENTION

It is an object of this invention to provide a raise bore rock bit capable of expansion.

More particularly, it is an object of this invention to provide a variable diameter raise bore rock bit having radially disposed segments mountable to a primary center body, the loads between which are primarily compressive loads rather than shear loads on attachment bolts.

An expandable large diameter rock bit is disclosed having a main center rock bit body forming a support structure. One or more cutter elements are rotatably mounted to the support structure formed by the center body. Extension portions are designed to have one or more of the cutter elements rotatably mounted to each extension. The extensions are attached to outer peripheral surfaces defined by the center body support structure by attachment means such that large surfaces are positioned adjacent the center body support structure with the plane of the surfaces being substantially normal to the substantially compressive loads imposed during operation of the expandable rock bit. Axial components of this compressive load are borne by radially extending abutting surfaces, whereas those load components acting radially inward are borne by large axially extending abutting surfaces.

An advantage then over the prior art is the transference of shear loads on attachment bolts for raise bit radially extending bit expansion segments to compressive loads by a unique method of attachment for the extension segment as taught in the present invention.

Yet another advantage over the prior art is the self-aligning feature as taught by the present invention when attaching the bit extension segments on the raise bit center body.

Still another advantage of the instant invention over the prior art is the use of wedge-type extension locking components acting in quadrature to align the radially extending segments while locking the segments on the raise bit center body.

The above noted objects and advantages of the present invention will be more fully understood upon a study of the following description in conjunction with the detailed drawings.

Figure 1:
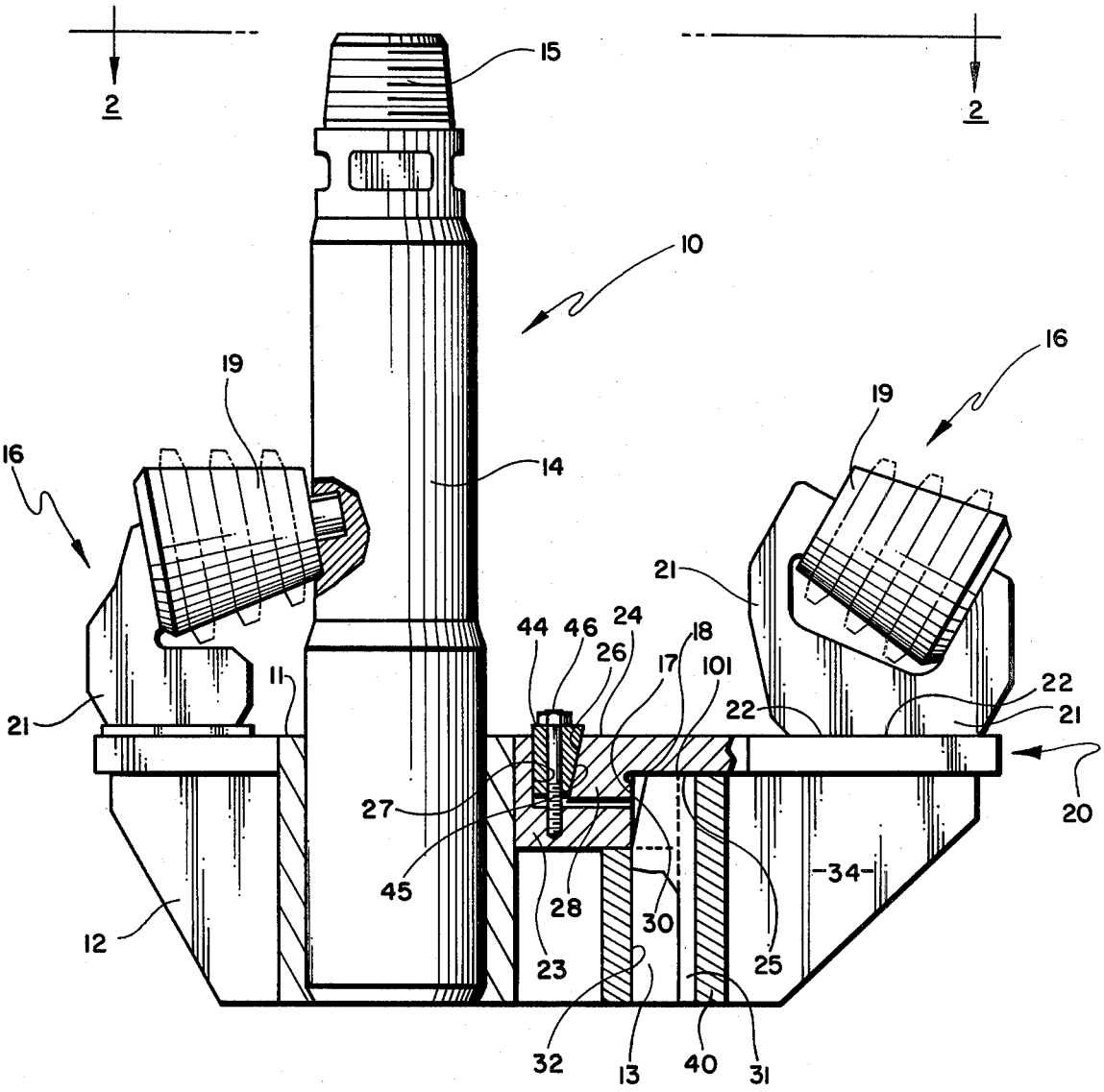
FIG. 1 is a partially broken away side elevational view illustrating a raise bore large diameter bit with an expandable segment attached thereto.
Figure 2:
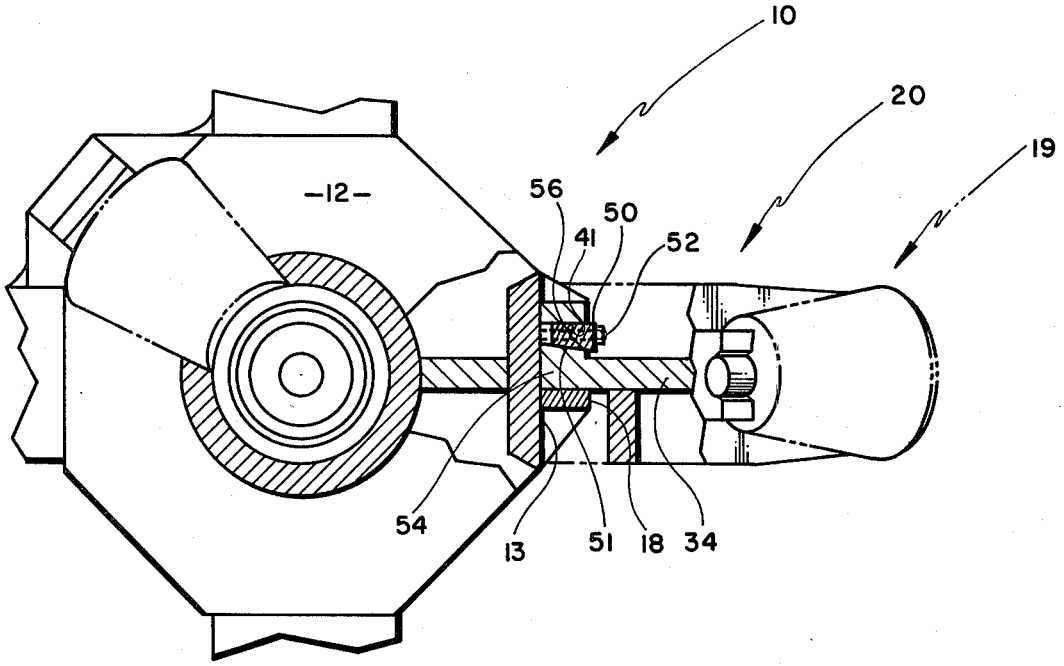
FIG. 2 is a view taken through 2—2 of FIG. 1 illustrating the expandable raise bore bit with the means in which the segments are secured to and aligned with the main center body of the bit.
Figure 3:
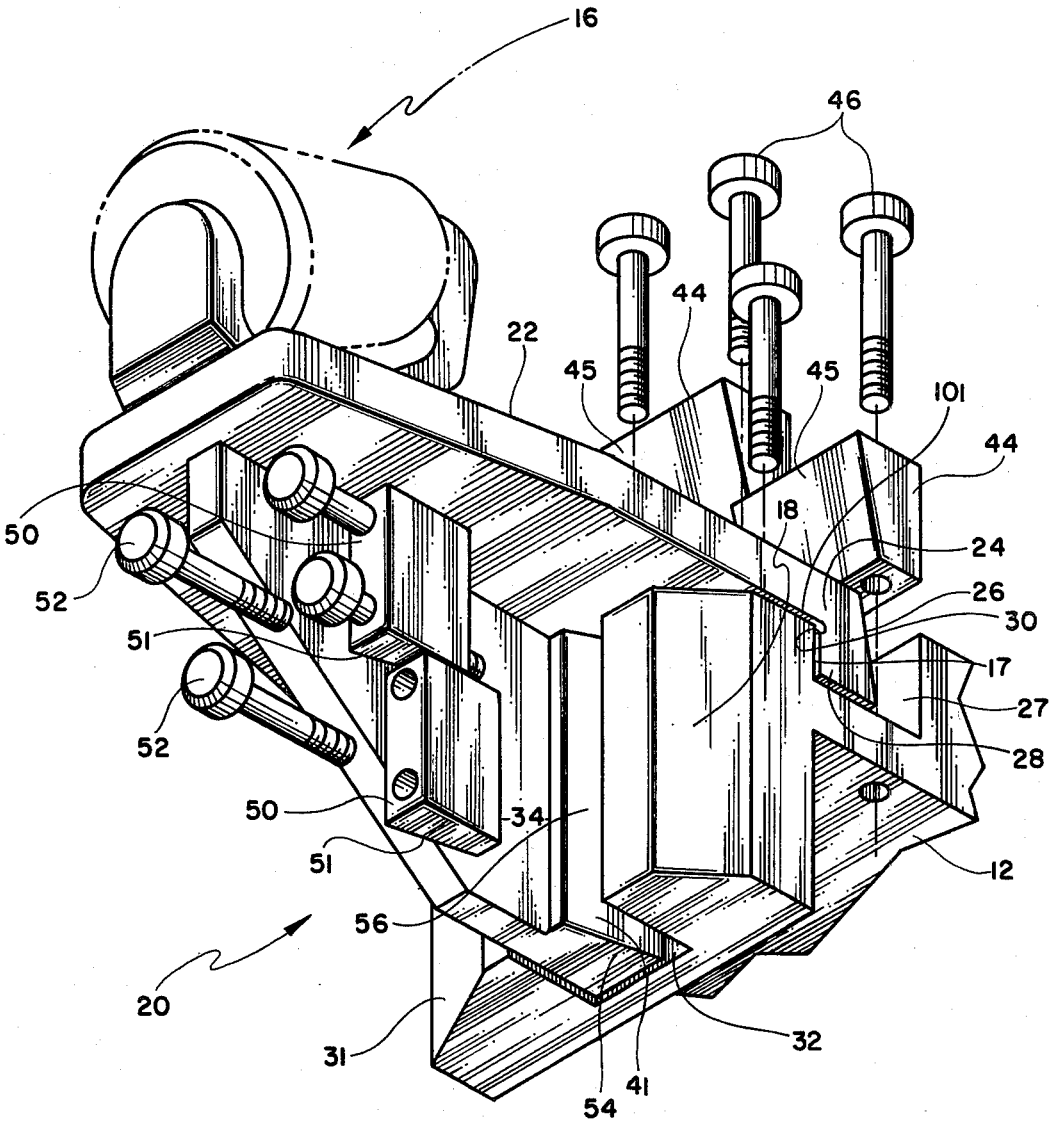
FIG. 3 is an exploded perspective view illustrating one detachable segment of the raise bore rock bit.
Figure 4:
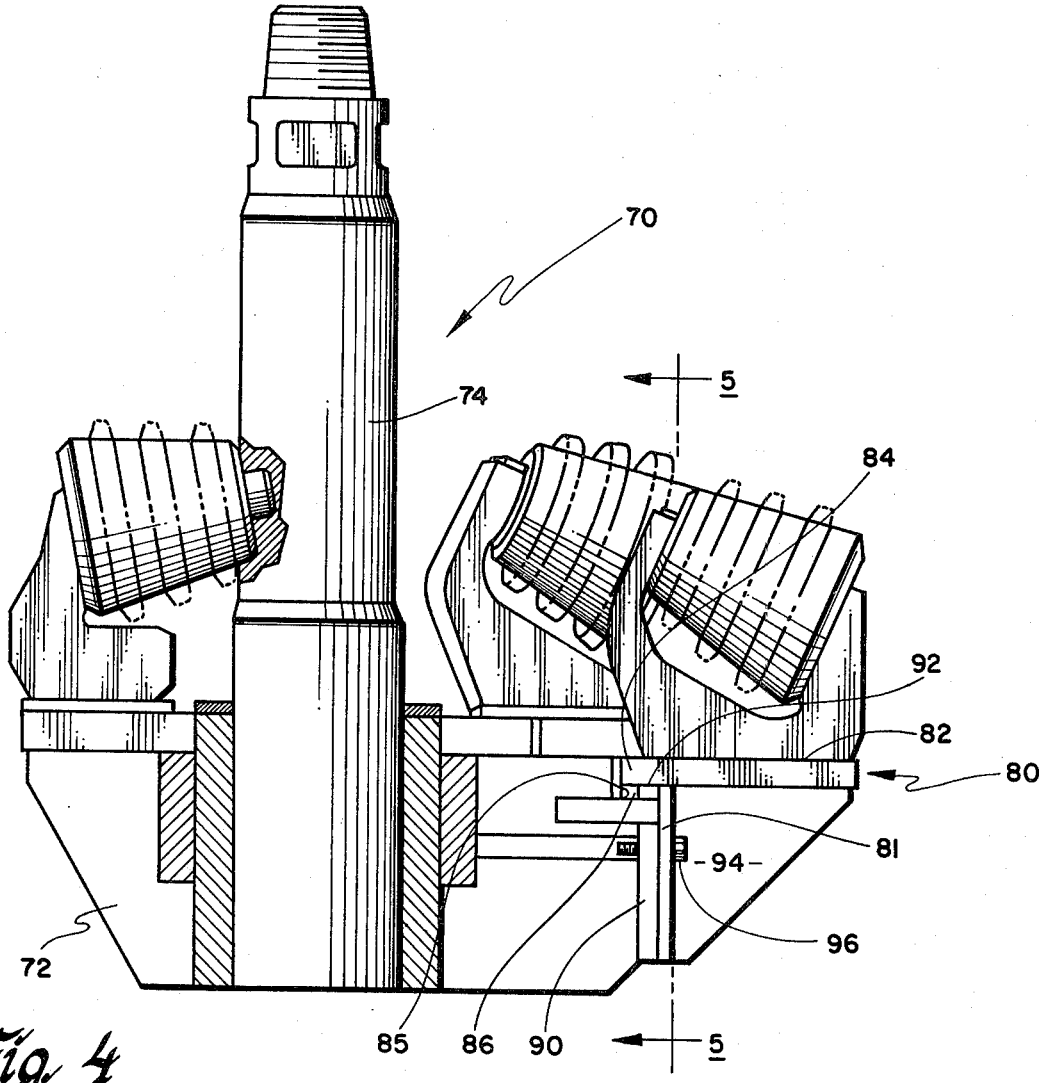

able section or segment, generally designated as 80, utilizes the same attaching or mounting principle as described with reference to FIGS. 1 through 3. The difference is that the segments 80 are not secured by a system of wedges and bolts. An upper surface or plate 82 overhangs support plate 90 secured to the center body 72. A vertical lip portion 86, below plate 82, overhangs support edge 92 of plate 90. Attachment end 84 of detachable segment 80 drops in via the ledge or lip portion 86 into a recess groove 85 in center section 72. A multiplicity of attachment bolts 96 extend radially through plate 81 of detachable segment 80 and adjacent vertical plate 90 fixed to center body 72.

The detachable segment is supported along edge 92 of vertical plate 90 so as to take primarily compressive loads along this surface, thus substantially negating any shear loads through attachment bolts 96.

Figure 5:
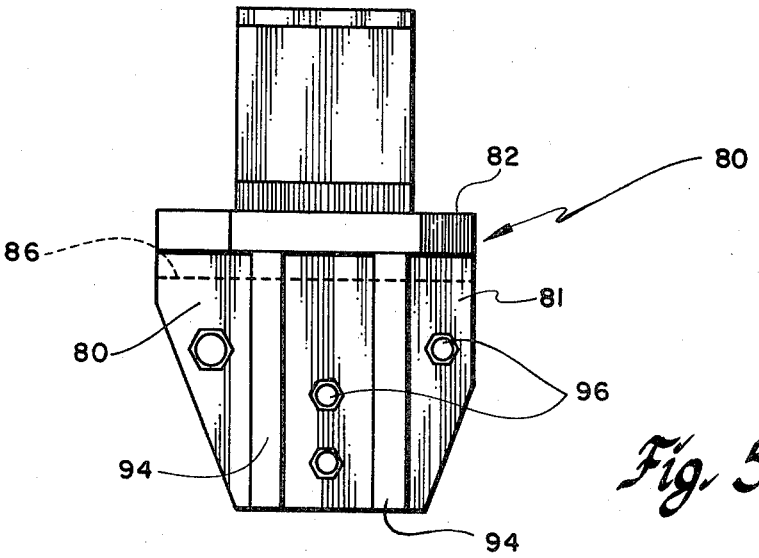

FIG. 5 clearly shows the orientation of the pair of vertical support plates 94 on detachable segment 80 and the orientation of each of the radially disposed attachment bolts 96 with respect to the center body 70.

Other types of big hole bits do not require a center stem portion. For example, tunneling machines, used primarily in mining operation, utilize large diameter bit bodies without a centrally positioned stem, the bit being mounted directly to the tunneling machine.

Additionally, stemless large hole bits called foundation sockets are sometimes required for excavating foundation footings for buildings and the like.

The above two examples fall within the teaching of the present invention.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. An expandable large diameter rock bit comprising:

a main center rock bit body, said center body forming a support structure, one or more cutter elements rotatively mounted to said support structure formed by said center body, at least one extension portion having one or more of said cutter elements rotatively mounted to said extension, each said extension being attached to an outer peripheral surface of said support structure formed by said center body tongue and groove by a first attachment means such that first large radially extending abutting surfaces and second large axially extending abutting surfaces are formed therebetween with the plane of said surfaces being substantially normal to a substantially compressive load imposed on said abutting surfaces, said first tongue and groove attachment means comprises one or more tapered wedge means having a first end and a second end, said wedge tapering from a wide first end to a narrow second end, said wedge being aligned in a plane substantially parallel with a centerline of said rock bit body, said wedge means being mounted within said first groove formed in said center body, said groove forming groove wall angles that complement said one or more tapered wedges, a second attachment means substantially transverse to said first tongue and groove attachment means comprises one or more wedge means having a first end and a second end, said wedge tapering from a wide first end to a narrow second end, said wedge being aligned in a plane substantially transverse to said centerline of said rock bit body, said second attachment means is mounted between a support block formed by said center rock bit body, said support block forms a surface for said wedge means that is parallel with said centerline of said bit body, a parallel support web formed by said extension portion forms a second groove between said support web and said support block forming groove wall angles that complement said tapered wedge means, said first and second wedge means secured within said first and second grooves by wedge mounting means serve to resist twisting modes imposed by the cutting action of said cutter means during operation of said expandable rock bit.

* * * * *